US008030586B2

(12) United States Patent
Villain et al.

(10) Patent No.: US 8,030,586 B2
(45) Date of Patent: Oct. 4, 2011

(54) ELECTRONIC SWITCH COMPRISING AN ELASTIC SHEET FOR HORIZONTALLY POSITIONING THE PUSHBUTTON

(75) Inventors: Jean-Christophe Villain, Dole (FR); Michel Cour, Sampans (FR)

(73) Assignee: CoActive Technologies, LLC, Newton, MA (US)

( * ) Notice: Subject to any disclaimer, the term of this patent is extended or adjusted under 35 U.S.C. 154(b) by 267 days.

(21) Appl. No.: 12/101,556

(22) Filed: Apr. 11, 2008

(65) Prior Publication Data

US 2008/0251369 A1 Oct. 16, 2008

(30) Foreign Application Priority Data

Apr. 12, 2007 (FR) ..... 07 54409

(51) Int. Cl.
*H01H 1/14* (2006.01)

(52) U.S. Cl. ..... 200/406; 200/512; 200/302.2

(58) Field of Classification Search ..... 200/534, 200/406

See application file for complete search history.

(56) References Cited

U.S. PATENT DOCUMENTS

| | | | | |
|---|---|---|---|---|
| 4,794,215 | A | 12/1988 | Sawada | |
| 4,843,197 | A * | 6/1989 | Kojima et al. | 200/406 |
| 5,343,008 | A * | 8/1994 | Ipcinski | 200/302.2 |
| 7,378,609 | B1 * | 5/2008 | Fedorjaka | 200/516 |

* cited by examiner

*Primary Examiner* — Renee S Luebke
*Assistant Examiner* — Lisa Klaus
(74) *Attorney, Agent, or Firm* — Pepper Hamilton LLP

(57) ABSTRACT

An electronic switch may include a horizontal bottom plate, a top side of the plate may support at least two electrical contacts. A contactor may be positioned on the top side of the plate and may be elastically deformable to electrically link the at least two electrical contacts. A pushbutton may be positioned vertically above the contactor such that manual displacement of the pushbutton downward may provoke the elastic deformation of the contactor. A first elastic sheet may include a top film protecting the contactor. The top film may be fixed to the top side of the plate to secure the contactor vertically on the plate to form an opening so that the pushbutton may act directly on the contactor. A second elastic sheet may position the pushbutton horizontally relative to the contactor on a top side of which the top film may be fixed.

15 Claims, 3 Drawing Sheets

ELECTRONIC SWITCH COMPRISING AN ELASTIC SHEET FOR HORIZONTALLY POSITIONING THE PUSHBUTTON

CROSS-REFERENCE TO RELATED APPLICATIONS

This application claims the benefit of priority to French Patent Application No. 0754409, filed Apr. 12, 2007, titled "Electronic Switch Comprising an Elastic Sheet for Horizontally Positioning the Pushbutton."

Not Applicable

BACKGROUND

The invention relates to a multidirectional control unit.

SUMMARY

In an embodiment, a vertical bulk of an electronic switch may be reduced. In an embodiment, an electronic switch may include a horizontal bottom plate. The horizontal top side may support at least two electrical contacts. A contactor may be positioned on the top side of the bottom plate and may be elastically deformable to electrically link at least two electrical contacts. A pushbutton may be positioned vertically above the contactor such that manual displacement of the pushbutton downward may provoke the elastic deformation of the contactor. A first elastic sheet may include a top film protecting the contactor which covers at least a portion of the contactor which is fixed to the top side of the plate, so as to secure the contactor vertically on the plate, and in which is formed an opening which is passed through by the pushbutton, so that a bottom section of the pushbutton may act directly on the contactor. A second elastic sheet may position the pushbutton horizontally relative to the contactor on a top side of which the top film may be fixed.

A conventional switch may include a vertical stacking of these various components. The vertical bulk of the switch may be determined by adding together the vertical dimensions of the components of the switch. To reduce the vertical bulk of the switch, the vertical plays between the components may be eliminated so that the vertical plays are directly in contact with each other.

In an embodiment, the vertical dimension of each component of the switch may be reduced. However, reducing the dimensions of a component also may reduce its mechanical resistance, which can reduce the life of the switch.

Furthermore, to keep the pushbutton in position on the contractor, the use of a metal cage may be arranged above the contactor. The cage may include an internal radially annular portion which may be passed through by the pushbutton and which may bear downward on an associated collar of the pushbutton. Via the annular portion, the cage may make it possible to both horizontally position the pushbutton on the contactor and block the upward displacement of the pushbutton on the contactor, and block the upward displacement of the pushbutton, to keep it in contact with the contactor.

However, the height of the annular portion of the cage may be added to the height of the other components of the switch. Consequently, the overall height of the switch may be increased by the presence of the cage.

In an embodiment, an electronic switch may include means of holding the pushbutton in position relative to the contactor, the design of which may make it possible to limit the vertical bulk of the switch without compromising the operation of the switch.

To this end, in an embodiment, a switch, as described previously, may include a second intermediate elastic sheet which positions the pushbutton horizontally relative to the contactor on a top side of which the top film may be fixed.

In an embodiment, the top side of the plate may include a substantially cylindrical recess of a vertical main axis. The horizontal bottom plate may support the electrical contacts and the contactor. The second intermediate sheet may be received in the recess to position the pushbutton horizontally relative to the contactor. The second sheet may include an elastic insert with a central orifice passed through by the pushbutton, the insert radially abutting against the vertical walls of the recess. The pushbutton may be made of a permanently deformable material, which is joined to the insert by crimping. The bottom section of the pushbutton may be fixed to a top side of the contactor. The pushbutton may be linked to the top film, so that the top film positions the pushbutton horizontally relative to the contactor. The pushbutton may be made by moulding or casting in a well delimited by the opening of the top film. The bottom of the well may be delimited by the top side of the contactor. The pushbutton may be glued to a top side of the contactor to position the pushbutton horizontally relative to the contactor. The top side of the plate may include a substantially cylindrical recess of a vertical main axis, the horizontal bottom plate may support the electrical contacts and the contactor.

BRIEF DESCRIPTION OF THE DRAWINGS

Other characteristics and advantages of the invention will become apparent from reading the detailed description which follows, for an understanding of which the reader should refer to the appended figures, in which.

DETAILED DESCRIPTION

Figure 1:
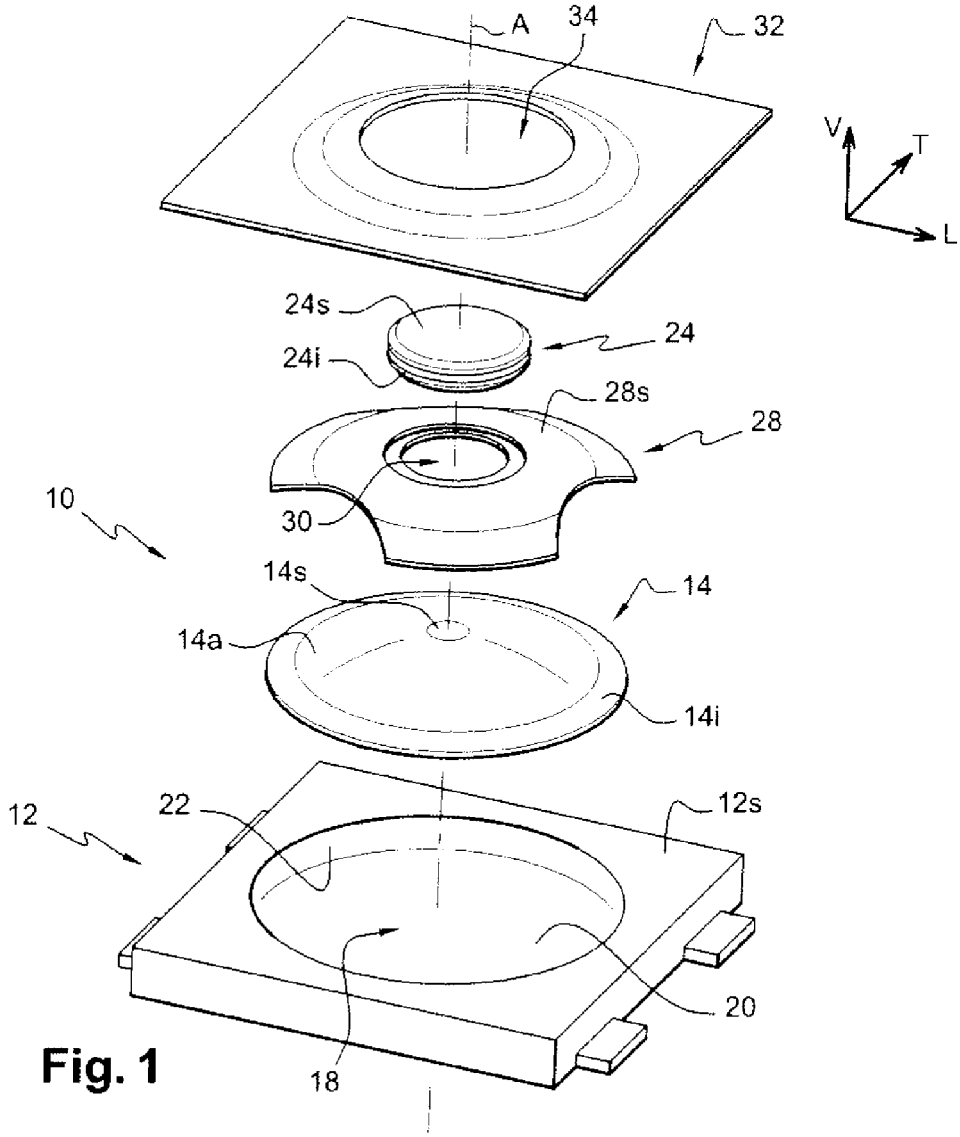
FIG. 1 is a schematic representation in an exploded perspective view of a switch including a rigid insert supporting the pushbutton according to an embodiment.

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein and in the appended claims, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

FIGS. 1-5 represent a pushbutton type switch 10 which is designed to be fitted on its own in an electronic appliance, such as, for example, a portable radio telephone, a computer, or in a keyboard of the electronic appliance. The switch 10 may comprise a support plate 12 which may include an overall flat horizontal plate. Two electrical contacts (not represented) may be fitted on the plate 12 and may be electrically linked when a user acts on the switch 10 to control the electronic appliance. The plate may support a contactor 14 including electrically conductive material which may be fitted on the plate 12 and which may be elastically deformable between a rest position, represented in FIGS. 1-5, and a position of actuation of the switch 10, in which it electrically connects the electrical contacts.

In an embodiment, the contactor 14 may include an element of revolution about vertical main axis A. The contactor 14 may be an upwardly dished convex shape forming a dome. The circular bottom base 14*i* of the contactor 14 may be in permanent contact with one of the two electrical contacts. The top portion 14*s* of the contactor 14, or summit, may move downward relative to the plate 12 when the contactor 14 is deformed, so that the summit 14*s* of the contactor 14 can come into contact with the other electrical contact when the user acts on the switch 10.

To enable an electronic appliance to be produced with small dimensions, in an embodiment, the dimensions of the contactor 14 may be small. For example, the external diameter of the contactor may be a few millimeters. Because of the small dimensions of the contactor 14, manipulating the contactor 14 to fit on the plate 12 may be difficult. To facilitate the positioning of the contactor 14 on the plate 12, the top side 12*s* of the plate 12 may include an overall vertical recess 18 in which the contactor 14 may be received. The electrical contacts may be positioned on the bottom 20 of the recess 18 and the contactor 14 may be placed on the bottom 20 of the recess 18.

In an embodiment, the recess 18 may be produced in such a way as to position the contactor 14 horizontally on the plate 12. The recess 18 may be a shape complementing the shape of the contactor 14 and the contactor 14 may be received with a little horizontal play relative to the cylindrical vertical walls 22 of the recess to allow for a radial expansion of the contactor 14 when it is deformed.

The deformation of the contactor 14 may be obtained by a user acting on an actuator. The actuator (not represented) may be positioned above the contactor 14 and may be fitted to move vertically relative to the switch 10 between a top rest position in which it is not acting on the contactor 14 and a bottom actuation position in which the actuator may bear downward against the contactor 14 to provoke a deformation of the contactor 14. When the actuator is in the bottom actuation position, the contactor 14 is in its bottom actuation position in which it may electrically link the two electrical contacts.

According to an embodiment of the contactor 14, the latter may form a disengageable end-stop of the actuator when it is in the top position, so that when the pressing force of the user is greater than a predetermined pressing force, the contactor 14 may be abruptly deformed to come into its bottom actuation position and may link the two electrical contacts. On this abrupt deformation, the user may sense a rapid modification of the displacement resistance which may be transmitted by the actuator and which may be likened by the user to a "click" of the switch 10. When the contactor 14 is in its bottom position, it may be deformed so that the summit 14*s* of the contractor 14 may be situated below the top side 12*s* of the plate 12.

As stated above, the external diameter of the contactor 14, and consequently, the internal diameter of the recess 18, may be relatively small. However, to allow a user to act on the actuator with one finger, the horizontal dimensions of the actuator may be greater than the diameter of the contactor 14 and of the recess 18. Thus, when the contactor 14 and the actuator are displaced to the actuation position of the switch 10. the actuator may abut against the top side 12*s* of the plate 12 before the contactor 14 may be sufficiently deformed to link the electrical contacts. In an embodiment, the switch 10 may not then operate reliably and effectively.

In an embodiment, the switch 10 may comprise an intermediate pushbutton 24 which may be arranged vertically between the contactor 14 and the actuator. The pushbutton 24 then may make it possible to transmit the actuation forces between the actuator and the contactor 14. The pushbutton 24 may make it possible to concentrate the pressure forces, produced by the user on the actuator, in a central zone of limited area of the contactor 14 which may be, in this embodiment, the summit 14*s* of the contactor 14.

The pushbutton 24 may be positioned roughly coaxially to the vertical axis A of the contactor 14 and its diameter may be less than the diameter of the contactor 14. The pushbutton 24 may be able to be displaced within the recess 18 and its height may be determined so that when the actuator and the contactor 14 are in the bottom actuation position, a top section 24*s* of the pushbutton 24 may project vertically upward relative to the top side 12*s* of the plate 12 to enable the actuator to act on the contactor 14.

The switch 10 may include at least one elastic sheet which may cover the contactor 14 and which may be made so that the pushbutton 24 may be positioned horizontally and vertically relative to the contactor 14. The elastic sheet may include an opening which may be passed through by the pushbutton 24. Thus, in an embodiment, the presence of the elastic sheet may not increase the overall height of the switch 10. Also, because the elastic sheet may include an opening, it may enable the bottom section 24*i* of the pushbutton 24 to be in direct contact with the contactor 14 and the top section 24*s* of the pushbutton 24 to come into direct contact with the actuator. This may provide for a direct transmission of the forces between the contactor 14 and the actuator via the pushbutton 24.

Figure 2:
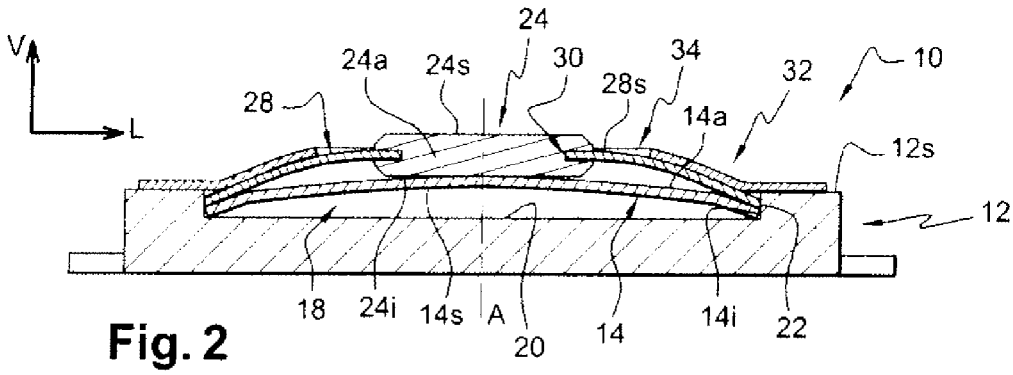
FIG. 2 is an axial cross section of the switch represented in FIG. 1 according to an embodiment.

According to FIGS. 1 and 2, the switch 10 may include a first top elastic sheet 32 which may cover the contactor 14 and which also may cover at least a portion of the top side 12*s* of the plate 12. The first sheet 32 may include a top film for protecting the contactor 14 and the electrical contacts to prevent any polluting element such as, but not limited to, dust from penetrating into the recess 18.

Hereinafter, the first sheet 32 may be referred to as "top film." The top film 32 may be fixed to the top side 12*s* of the plate 12 by, for example, gluing. The top film 32 may bear downward against the top side 14*a* of the contactor 14. The top film 32 may make it possible to provide, on the one hand, the internal seal-tightness of the switch 10, and on the other hand, the top film may make it possible to secure the contactor 14 vertically in the recess 18.

In an embodiment, the top film 32 may be elastically deformable so that when the user acts on the actuator, the top film 32 may be deformed when the contactor 14 is deformed. This may make it possible to maintain the seal-tightness of the closure of the recess 18. In an embodiment, the top film 32 may include a central opening 34 which may be passed through by the pushbutton 24, so that the top film does not influence the overall height of the switch 10.

FIGS. 1 and 2 represent a first embodiment of the switch 10 according to which the horizontal and vertical positioning of the pushbutton 24 may be obtained through a second intermediate flexible sheet 28 which may be positioned between the top film 32 and the contactor 14. The second sheet 28 may include a flexible insert 28, or disc shaped chip, which may be received in the recess 18 which can be deformed in a way connected to the pushbutton 24 upon actuation of the switch 10.

In an embodiment, the insert 28 may include a central opening 30 which may be passed through by the pushbutton 24. In an embodiment, the insert 28 may be made so as to keep the pushbutton 24 in position coaxially on the contactor 14 in such a way as to prevent any radial displacement of the pushbutton 24 relative to the contactor 14. For this, the insert 28 may be received in the recess 18 with a small radial play and the pushbutton 24 may be received in the opening 30 of the insert 28 with no radial play. The small radial play of the insert 28 in the recess 18 may make it possible to increase the external diameter of the insert 28 on its deformation concurrent with the deformation of the contactor 14.

In an embodiment, in another aspect of the insert 28, the vertical holding of the pushbutton 24 in contact with the summit 14*s* of the contactor 14 may be obtained by the insert 28. By way of nonlimiting example, the pushbutton 24 may be crimped onto the insert 28 through the opening 30.

In an embodiment, the external diameter of the top section 24*s* of the pushbutton 24 and the external diameter of the bottom section 24*i* of the pushbutton 24 may be greater than the internal diameter of the opening 30. The pushbutton 24 may include an intermediate section 24*a* which may link the top section 24*s* and the bottom section 24*i* and which may be located in the opening 30, the external diameter of which may be equal to the internal diameter of the opening 30. In an embodiment, the crimping of the pushbutton 24 onto the insert 28 may be done on equipment separate from the equipment for positioning the pushbutton 24 and/or the insert 28 on the plate 12.

In an embodiment, before being crimped on the insert 28, the pushbutton 24 may include an element of cylindrical shape which may be introduced through the opening 30 of the insert 28. This element may be made of a permanently deformable material such as, for example, a polymer material. This cylindrical element may be deformed permanently by two jaws that are brought vertically towards each other. The vertical compression of the cylindrical element may cause a radial expansion of the material to obtain the shape represented in FIGS. 1 and 2. The pushbutton 24 may be subjected to processing. For example, for polymerization of the pushbutton 24, to retain its shape, the pushbutton 24 may be subjected to a calibration of its height. The application of such a method of crimping the pushbutton 24 onto the insert 28 may make it possible to have an effective joining of the pushbutton 24 to the insert 28, and to control the height of the pushbutton 24 in order to limit the overall vertical bulk of the switch 10.

In an embodiment, the pushbutton 24 may be made by overmoulding plastic material through the opening 30 of the insert 28. The insert 28 may be held vertically in the recess 18 by a top film 32 which may bear vertically downward against the top side 28*s* of the insert 28. To maintain a seal-tight blocking of the recess 18, the film 32 may be fixed to the top side 28*s* of the insert 28, for example, by gluing close to the edges of its opening 34.

Figure 3:
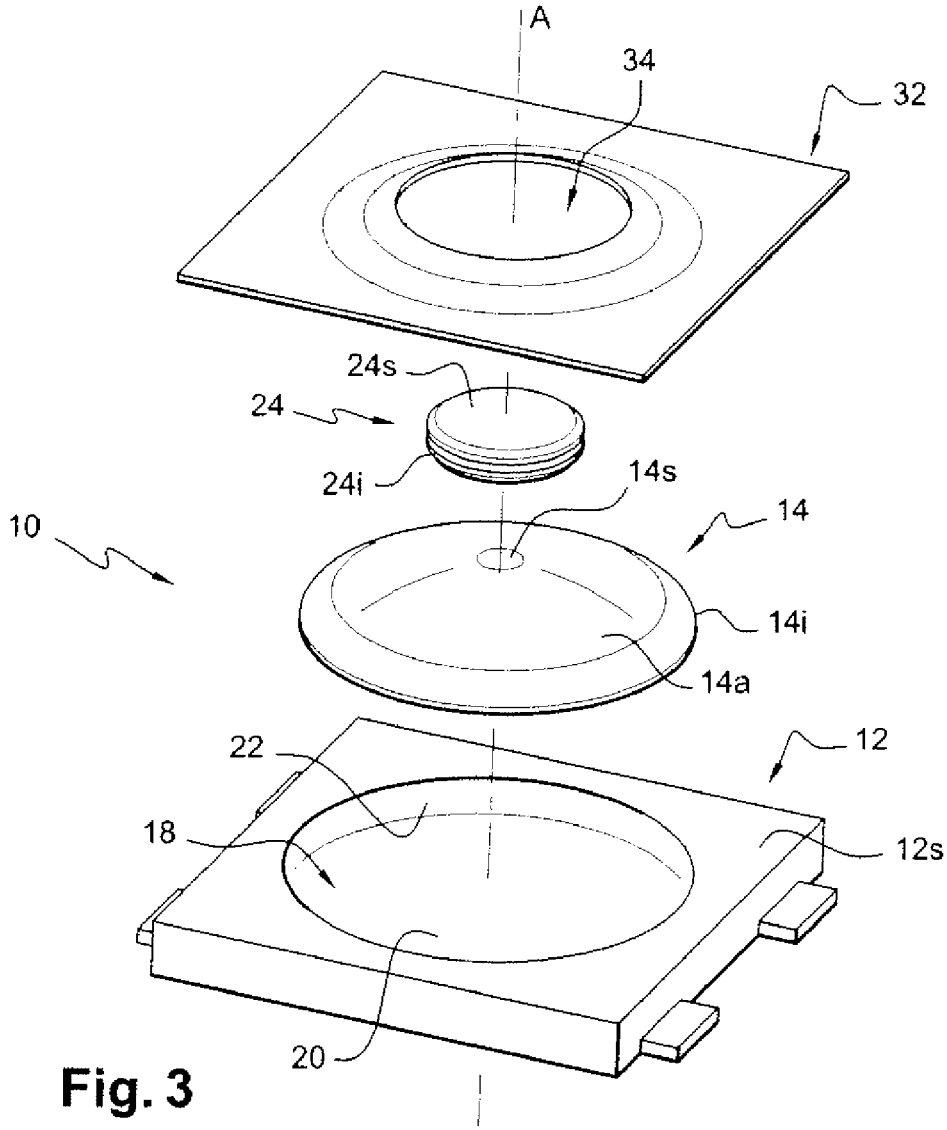
FIG. 3 is a schematic representation in an exploded perspective view of a switch according to an embodiment.
Figure 4:
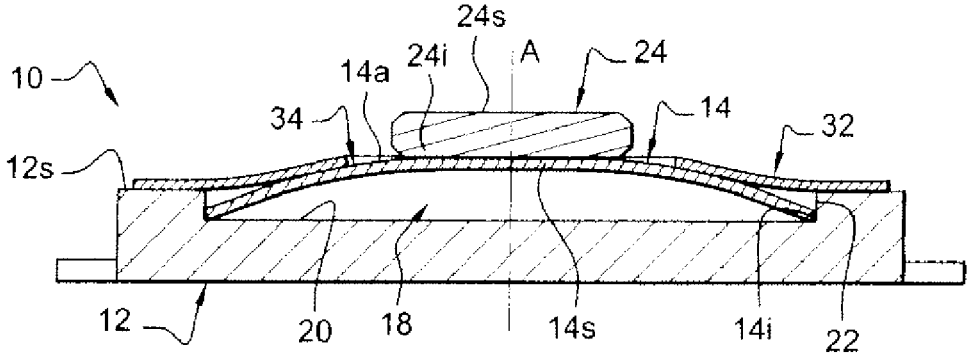
FIG. 4 is an axial cross section of the switch represented in FIG. 3 according to an embodiment.
Figure 5:
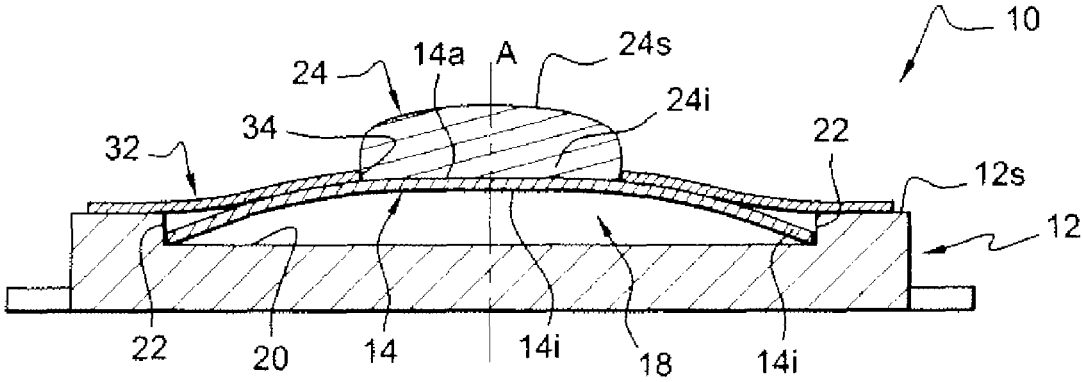
FIG. 5 is a view similar to that of FIG. 4, showing an embodiment variant of the switch, in which the pushbutton is cast through the opening in the top film according to an embodiment.

FIGS. 3 to 5 represent the switch 10 in which only the top film 32 covers the contactor 14 according to an embodiment. As stated above, the top protective film 32 may include an opening 34 which may be passed through by the pushbutton 24, so that the film 32 does not increase the overall height of the switch 10. Thus, the bottom section 24*i* of the pushbutton 24 may be in direct contact with the summit 14*s* of the contactor 14.

According to an embodiment, the pushbutton 24 may be horizontally positioned and may be secured vertically relative to the contactor 14 by joining the bottom section 24*i* of the pushbutton 24 directly to the summit 14*s* of the contactor 14 by, for example, gluing.

In an embodiment, the pushbutton 24 and the top film 32 may be fitted on the plate 12 and the contactor 14 in separate assembly steps. Thus, to allow for a horizontal offset of the pushbutton 24 relative to the top film 32, the internal diameter of the opening 34 of the top film 32 may be greater than the external diameter of the pushbutton 24. For a seal-tightness to be provided by the top film 32 at its opening 34, the top film 32 may be fixed directly to the top side 14*a* of the contactor 14 level with the edge of the opening 34, so that the summit 14*s* of the contactor may block off the opening 34 of the top film 32.

As stated above, the contactor 14 may be an element of small dimensions. As a result, the dimensions of the pushbutton 24 may be very small. Thus, the joining of the pushbutton 24 to the contactor 14 by gluing the bottom side of the pushbutton 24 to the top side 14*a* of the contactor, that is, over a relatively small surface area, may have a life that is insufficient relative to the minimum number of operations that the switch 10 must be capable of sustaining.

FIG. 5 represents a variant according to an embodiment. In an embodiment, the horizontal positioning of the pushbutton 24 relative to the contactor 14 may be obtained by casting a certain quantity of a material forming the pushbutton 24 in the opening 34 of the top film 32. The casting operation may be applied after positioning the top film 32 on the plate 12 and on the contactor 14. Thus, the opening 34 of the top film 32 and the top side of the summit 14*s* of the contactor 14 may form an overall cylindrical well that may be open at the top, which can receive the quantity of material intended to form the pushbutton 24.

In an embodiment, the quantity of the material intended to form the pushbutton 24 may be determined in such a way as to fill all of the volume delimited by the opening 34 of the top film 32 and the summit 14*s* of the contactor 14 to form the bottom section 24*i* of the pushbutton 24. In an embodiment, this quantity may be determined in such a way that the pushbutton 24 may project upward relative to the top film 32, to form the top section 24*s* of the pushbutton 24, and in such a way that the summit of the top section 24*s* of the pushbutton 24 may be located at a given height to have a control over the overall height of the switch 10.

Such an embodiment of the pushbutton 24 may make it possible to increase the contact area between the pushbutton 24 and the contactor 14, where the pushbutton may adhere to the top side 14*a* of the contactor 14, compared to a previous embodiment. Thus, the pushbutton 24 may be held vertically on the contactor 14 by this adhesion of the material which has been cast to form the pushbutton 24 with the material forming the contactor 14. Furthermore, according to an embodiment, the pushbutton 24 may be in contact with the edges of the opening 34, which may enable the top film 32 to keep the pushbutton 24 in position on the contactor.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An electronic switch system comprising:

a horizontal bottom plate, wherein a top side of the horizontal bottom plate supports at least two electrical contacts;

a contactor positioned on the top side of the horizontal bottom plate, wherein the contactor is elastically deformable to electrically link the at least two electrical contacts;

a pushbutton positioned vertically above the contactor, such that manual displacement of the pushbutton downward will provoke the elastic deformation of the contactor;

a first elastic sheet comprising a top film protecting the contactor, which covers at least a portion of the contactor, wherein the first elastic sheet is securely fixed to the top side of the horizontal bottom plate to secure the contactor vertically on the horizontal bottom plate to form an opening which is passed through by the pushbutton so that a bottom section of the pushbutton acts directly on the contactor; and a second elastic sheet which positions the pushbutton horizontally relative to the contactor on a top side of which the top film is fixed and sealed.

2. The system of claim 1 wherein the top side of the horizontal bottom plate comprises a substantially cylindrical recess of a vertical main axis, wherein the horizontal bottom plate supports the at least two electrical contacts and the contactor, and wherein the second sheet is received in the recess to position the pushbutton horizontally relative to the contactor.

3. The system of claim 1 wherein the second sheet comprises an elastic insert with a central orifice passed through by the pushbutton, wherein the insert radially abuts against the vertical walls of the recess.

4. The system of claim 3 wherein the pushbutton comprises a permanently deformable material joined to the insert by crimping.

5. An electronic switch system comprising:

a horizontal bottom plate supporting at least two electrical contacts and a contactor, wherein a top side of the horizontal bottom plate supports the at least two electrical contacts and comprises a substantially cylindrical recess of a vertical main axis;

the contactor positioned on the top side of the horizontal bottom plate, wherein the contactor is elastically deformable to electrically link the at least two electrical contacts;

a pushbutton positioned vertically above the contactor, such that manual displacement of the pushbutton downward will provoke the elastic deformation of the contactor;

a first elastic sheet comprising a top film protecting the contactor, which covers at least a portion of the contactor, wherein the first elastic sheet is securely fixed to the top side of the horizontal bottom plate to secure the contactor vertically on the horizontal bottom plate to form an opening which is passed through by the pushbutton so that a bottom section of the pushbutton acts directly on the contactor; and a second elastic sheet which positions the pushbutton horizontally relative to the contactor on a top side of which the top film is fixed and sealed, wherein the second sheet is received in the recess to position the pushbutton horizontally relative to the contactor and wherein the second sheet comprises an elastic insert with a central orifice passed through by the pushbutton, wherein the insert radially abuts against the vertical walls of the recess.

6. The system of claim 5 wherein the pushbutton comprises a permanently deformable material joined to the insert by crimping.

7. An electronic switch system comprising:

a horizontal bottom plate, wherein a top side of the horizontal bottom plate supports at least two electrical contacts;

a contactor positioned on the top side of the horizontal bottom plate, wherein the contactor is elastically deformable to electrically link the at least two electrical contacts;

a pushbutton positioned vertically above the contactor, such that manual displacement of the pushbutton downward will provoke the elastic deformation of the contactor;

a first elastic sheet comprising a top film protecting the contactor, which covers at least a portion of the contactor, wherein the first elastic sheet is securely fixed to the top side of the horizontal bottom plate to secure the contactor vertically on the horizontal bottom plate to form an opening which is passed through by the pushbutton so that a bottom section of the pushbutton is vertically secured directly on the contactor; and a second elastic sheet which positions the pushbutton horizontally relative to the contactor on a top side of which the top film is fixed and sealed.

8. The system of claim 7 wherein the top side of the horizontal bottom plate comprises a substantially cylindrical recess of a vertical main axis, wherein the horizontal bottom plate supports the at least two electrical contacts and the contactor, and wherein the second sheet is received in the recess to position the pushbutton horizontally relative to the contactor.

9. The system of claim 7 wherein the second sheet comprises an elastic insert with a central orifice passed through by the pushbutton, wherein the insert radially abuts against the vertical walls of the recess.

10. The system of claim 9 wherein the pushbutton comprises a permanently deformable material joined to the insert by crimping.

11. An electronic switch system comprising:

a horizontal bottom plate, wherein a top side of the horizontal bottom plate supports at least two electrical contacts;

a contactor positioned on the top side of the horizontal bottom plate, wherein the contactor is elastically deformable to electrically link the at least two electrical contacts;

a pushbutton secured vertically above and to the contactor, such that manual displacement of the pushbutton downward will provoke the elastic deformation of the contactor;

a first elastic sheet comprising:

a top film protecting the contactor, which covers at least a portion of the contactor, wherein the first elastic sheet is securely fixed to the top side of the horizontal bottom plate to secure the contactor vertically on the horizontal bottom plate to form an opening which is passed through by the pushbutton so that a bottom section of the pushbutton is vertically secured directly on the contactor, and a bottom surface fixed to the contactor; and a second elastic sheet which positions the pushbutton horizontally relative to the contactor on a top side of which the top film is fixed and sealed.

12. The system of claim 11, wherein the bottom surface is directly affixed to the contactor.

13. The system of claim 11 wherein the top side of the horizontal bottom plate comprises a substantially cylindrical recess of a vertical main axis, wherein the horizontal bottom plate supports the at least two electrical contacts and the contactor, and wherein the second sheet is received in the recess to position the pushbutton horizontally relative to the contactor.

14. The system of claim 11 wherein the second sheet comprises an elastic insert with a central orifice passed through by the pushbutton, wherein the insert radially abuts against the vertical walls of the recess.

15. The system of claim 14 wherein the pushbutton comprises a permanently deformable material joined to the insert by crimping.

* * * * *